US006341414B1

(12) United States Patent
Leu

(10) Patent No.: US 6,341,414 B1
(45) Date of Patent: Jan. 29, 2002

(54) METHOD FOR PREPARING AN INDUCTANCE ELEMENT

(75) Inventor: Tsung-Fu Leu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/408,848

(22) Filed: Sep. 30, 1999

(51) Int. Cl.[7] ..... H01F 41/04
(52) U.S. Cl. ..... 29/602.1
(58) Field of Search ..... 29/602.1, 607, 29/608

(56) References Cited

U.S. PATENT DOCUMENTS 3,154,840 A * 11/1964 Shahbender ..... 29/602.1 X
6,073,339 A * 6/2000 Levin ..... 29/602.1 X

* cited by examiner

*Primary Examiner*—Carl E. Hall
(74) *Attorney, Agent, or Firm*—Dougherty & Troxell

(57) ABSTRACT

The resent disclosure relates to an inductance element and its preparation method. The inductance element comprises a coil structure, an insulation layer, a conductive metal layer and a metal core layer. The preparation method comprises, preparation of a coil structure, applying an insulation material on said coil structure to fix said coil structure, applying a conductive metal layer to form a multiple-layered core structure. In the preparation of the multiple-layered core structure, an intermittent plating approach is adopted, such that the cross-sectional area of the magnetic circuit may be increased. The coil structure applicable to this invention includes one prepared on a printed circuit board or a winded enameled wire coil structure. When a group of two coils is prepared, the inductance element may function as a transformer.

5 Claims, 3 Drawing Sheets

METHOD FOR PREPARING AN INDUCTANCE ELEMENT

FIELD OF THE INVENTION

The present invention relates to a small-scaled inductance element and its preparation method, especially to a method of encapsulating an inductive coil by plating a magnetic material thereon and the inductance element so prepared.

BACKGROUND OF THE INVENTION

The term "inductance element" generally refers to elements such as inductor and transformer. The structure of an inductance element comprises a coil structure and a core. If a transformer is the case, it is used to transform a voltage or a current into another voltage or a current. Ideally, its transformation rate is preferably 100% and its volume and weight are zero. However, it is already known from the prior art that the transformation rate is influenced by material of core and process of manufacture.

In the prior art, materials for core included silicon steel plate and soft magnetic material such as Ferrite and Permalloy. The soft magnetic material provides higher magnetic flux density endurance capability. Although the cost of soft magnetic material is relatively higher, it is frequently used in the industry due to its lower material consuming and lighter weight.

In the preparation of the inductance element, the core structure may be prepared with multiple levels of silicon steel sheets or Permalloy sheets. A sheet structure provides larger effective area of magnetic circuit. In the prior art, however, the volume and weight of the core is still a problem to be solved.

In addition to this, the winding process of the coil is a time consuming process in the preparation of the inductance element. In order to simplify the preparation of the inductance element, a printed circuit board approach was developed. In U.S. Pat. No. 5,761,791 (issued to Bando) disclosed a technology in which two coil structures were first prepared on a printed circuit board and sintered cores made of Ferrite or Permalloy are then affixed to the coil to form a transformer. In the Bando invention, however, the core is sintered during the preparation. As a result, only cores with E-shape or O-shape may be prepared. The effective area of the magnetic circuit is relatively low. On the other hand, because the cores are affixed to the coils, the shape of the core is limited by the requirements in the assembly process. For example, the ideal shape of the cores should be loop shape. A loop-shaped core is difficult to be positioned and assembled. In order to facilitate the assembly, the core is preferably E-shape or I-shape. Waste of material is thus caused.

Nevertheless, when the cores are affixed to the coils, gaps and spaces are left between them. The gaps and spaces cause large leakage of the flux and heating. In addition, cores prepared with sintering perform high contraction rate, so that deformations are always found. Such characters damage the yield rate of the inductance element. Other problems of this technology include expensive manufacture costs. This is because different molds shall be prepared for different transformers so that the cores may be sintered inside the molds.

It is thus a need in the industry to have a simplified preparation method for small-scale inductance element.

It is also a need in the industry to have a novel preparation method for small-scale inductance element where no sinter and adhesion processes are needed.

It is also a need to have a novel preparation method for small-scale inductance element where shapes of components are not limited by the process used.

It is also a need to have a novel preparation method for small-scale inductance element so that inductance elements with high efficiency and yield rate may be obtained.

OBJECTIVES OF THE INVENTION

The objective of this invention is to provide a novel and simplified preparation method for small-scale inductance element.

Another objective of this invention is to provide a novel preparation method for small-scale inductance element where no sinter and adhesion processes are needed.

Another objective of this invention is to provide a preparation method for inductance element where shapes of components are not limited by the process used.

Another objective of this invention is to provide a preparation method for inductance element so that inductance elements with high efficiency and yield rate may be obtained.

Another objective of this invention is to provide a method for preparation of inductance element with multiple-layered cores.

Another objective of this invention is to provide a novel structure of inductance element.

Another objective of this invention is to provide an inductance element with simplified preparation process and enhanced working efficiency.

Another objective of this invention is to provide an inductance element with higher yeild rate.

SUMMARY OF THE INVENTION

According to this invention, a novel inductance element and its preparation method are disclosed. The inductance element of this invention comprises at least one coil structure, an insulation layer, a conductive metal layer and a least one metal core structure. In the preparation method for inductance element of this invention, at least one coil structure is prepared and at least one core structure is prepared with the plating technology. An intermittent plating approach is used to prepare the cores so that a core structure with multiple layers may be obtained. The coil structure applicable to this invention includes one prepared on a printed circuit board or a winded enameled wire coil structure. When a group of two coils is prepared, the inductance element may function as a transformer.

When a transformer is to be prepared, the permeability s of the core structure and the coil structure are first considered. Suited material for the core structure and the coil structure include Ferrite (with a permeability of about 500 to 1300) and Permalloy (with a permeability of above 2000).

The above and other objectives and advantages of this invention may be clearly understood from the detailed specification by referring to the following drawings.

DETAILED DESCRIPTION OF THE INVENTION

Figure 1A:
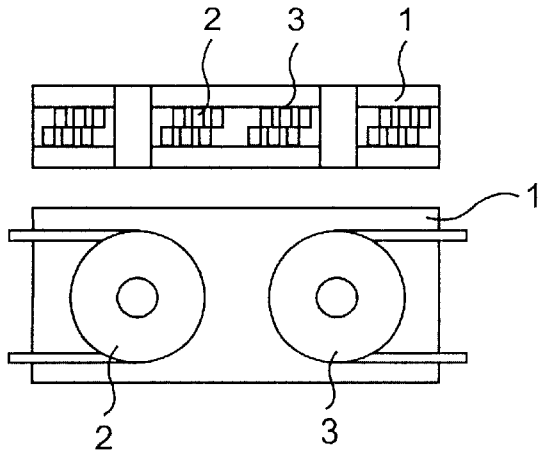
FIGS. 1(*a*) through 1(*c*) illustrate a flow chart of the preparation method for inductance element of this invention.

The present disclosed a novel preparation method for inductance element wherein plating technology of metal or metal alloys is used to prepare the core structure. The inductance element prepared according to this invention contains no gap or space between its coils and its core. No assembly neither sintering process is required in the preparation method for inductance element of this invention.

In order to describe the preparation method and structure of the invented inductance element, a brief description of the prior art is given below, by taking the above-said U.S. Pat. No. 5,761,791 as an example.

According to U.S. Pat. No. 5,761,791, process in the preparation of an inductance element includes the following steps:

1. A substrate with a first circuit is first prepared.
2. A first insulation layer is formed on said first circuit.
3. A number of electrodes having a first loop pattern is formed on said first insulation layer.
4. A second insulation layer is prepared on said patterned electrode layer and another layer of electrodes with a second loop pattern is prepared on said second insulation layer such that the second pattern overlaps with the first pattern.

In this step, the first and the second insulation layers are prepared with curable polyimide resin through exposure and development, the first and the second patterns have substantially the same line width and the electrodes of the first and the second patterns are overlapping with each other and divided by the insulation layer.

5. A third insulation layer is prepared in a similar way so to obtain a multiple layered structure.
6. Cut the multiple layered structure to have a number of multiple layered units.
7. External electrodes are prepared to connect the external surface of the first and the second patterns.

According to this prior art, more layers of the patterned electrode layers may be prepared so to function as a coil structure.

In this prior art, the core and the coil are prepared simultaneously. However, because the coil structure is prepared on a substrate where a core locates, the structure, shape and material of the core is limited by the process in the preparation of the coil. As a result, it is difficult to use materials that generate larger effective area of magnetic circuit to prepare the core.

In the method of this invention, the coil structure is first prepared on a substrate which may be a printed circuit board. The core structure is then prepared using the plating technology. Although it is not intended to limit the scope of this invention, the flux of the coil structure so prepared is able to define the position of deposition of the core material. As a result, the shape and position of the core structure may be automatically adjusted to comply with some requirements of the inductance element, costs of the materials may be saved and costs in the adjustment and control of the preparation of the inductance element may also be saved.

In the prior art, breaks may cause terrible losses in the preparation of electronic components. In the present invention, however, intermittent breaks are used in the plating process of the core structure so to generate a multiple-layered core structure, such that the working efficiency of the inductance element may be enhanced.

Figure 1B:
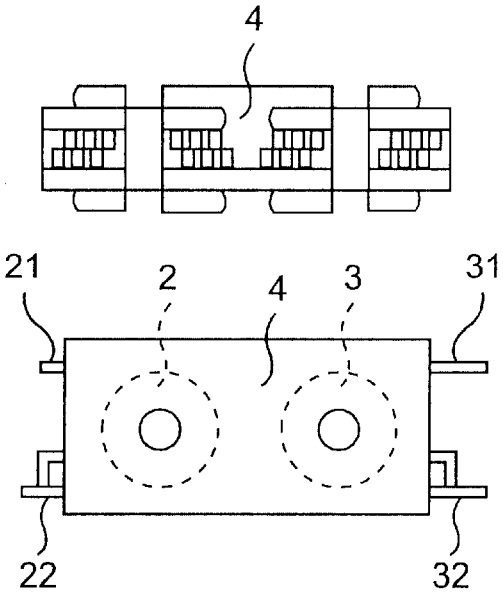
Figure 1C:
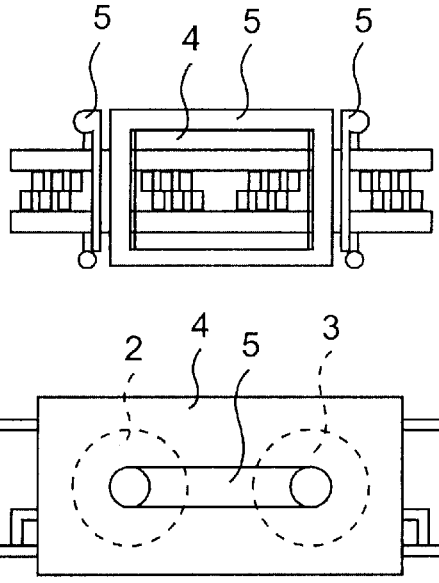

The following is a description of an embodiment of the preparation method for inductance element of this invention. FIG. 1 illustrates the flow chart of the preparation method for inductance element of this invention.

As shown in this figure, in the preparation of an inductance element, its coils are first prepared. In this embodiment, the coils may be prepared in a multiple-layered structure with a Ferrite material. In preparing the coils, the process disclosed in the said U.S. Pat. No. 5,761,791 may be adopted. If such process is used, the first substrate may be replaced by a printed circuit board or a substrate of other materials.

In this embodiment, the coils may be a wound enameled wire coil structure. No matter how the coils are prepared, the materials of the conductive and the insulation are already known to those skilled in the art. Detailed description thereof is thus omitted.

A coil structure so prepared is shown in FIG. 1(*a*) wherein 1 represents substrate, 2 and 3 represent coils. See also FIG. 3 wherein 21, 22, 31 and 32 represent the external sides of coils 2 and 3.

After the coils are prepared, metallization is made at external ends of the coils. In this step, a conductive material is used to connect one end of each coil and the N electrode of the plating power supply (see FIG. 2) is connected to another end of each coil. The purpose of this step is the preprocessing of the core so to facilitate the deposition of the core material. Applicable technologies in this stet include physical vapor deposition (PVD) and chemical vapor deposition (CVD).

Before the conductive materials are formed on the coil structure, an insulation layer 4 shall be prepared on the coil structure layer. FIG. 1(*b*) shows the invented structure after the insulation layer 4 is prepared. Applicable materials for the insulation layer include paints. A conductive layer 5 is then formed on the insulation layer 4. Applicable materials for the conductive include Ag, Au and Ti. The structure so prepared is shown in FIG. 1(*c*).

The core structure is then prepared on the conductive layer. In this embodiment, the core structure is prepared using the plating technology. Applicable materials for the core structure include any applicable metal or metal alloys. If a soft magnetic material is used, it may be 21% Permalloy (a Fe-Ni alloy) alloy or a super Permalloy (a Fe-Ni-Mo alloy). (Permalloy and super Permalloy are tradenames of Philips.)

It is noted that, in the preparation of an inductance element the thinner core structure is, the lower the eddy current, and thus the eddy lose, will be. Soft magnetic materials may be used to prepare core structures with minimum thickness and are thus preferable in this embodiment.

Figure 2:
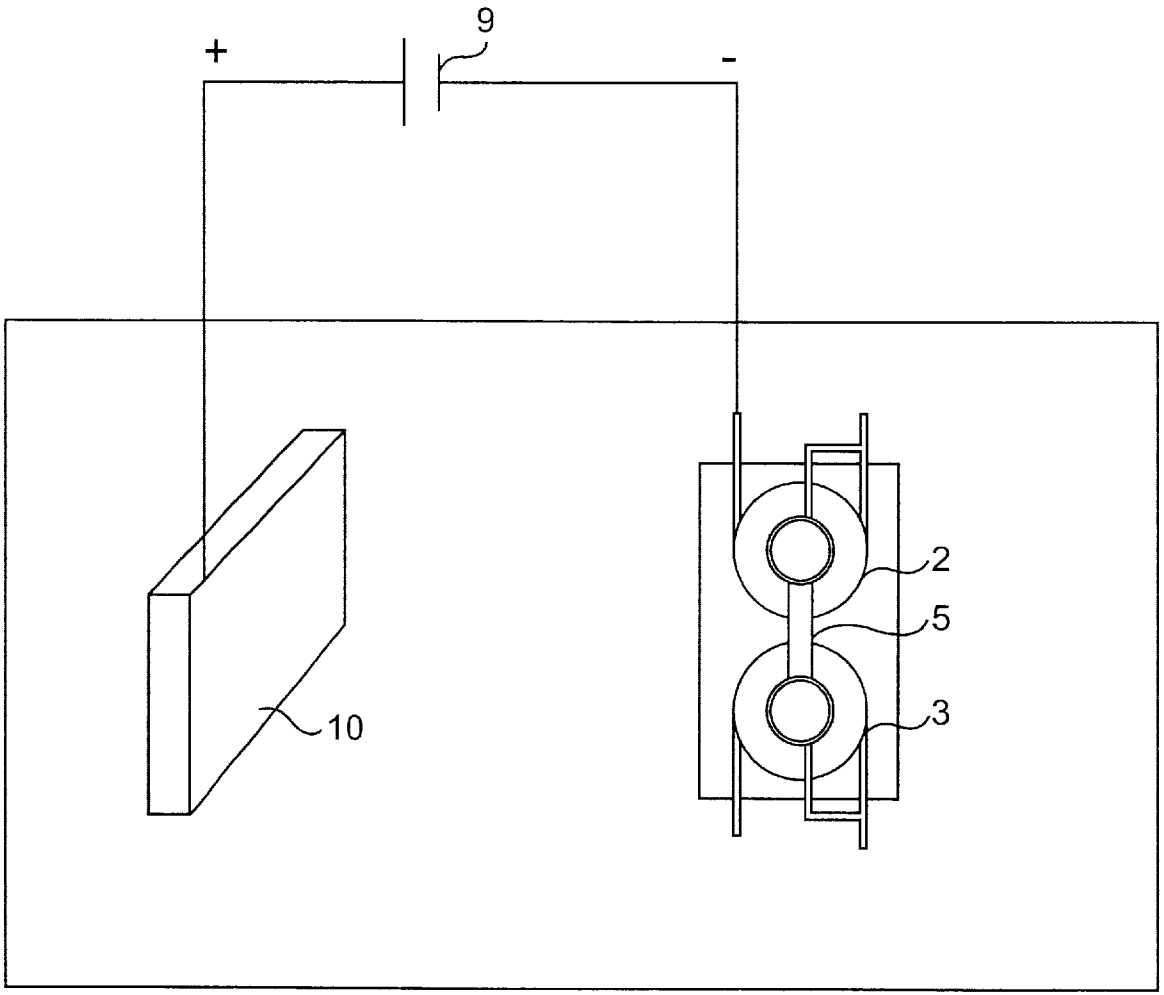
FIG. 2 illustrates the plating system of the core structure, suited in the preparation method for inductance element of this invention.

If the core structure is prepared with the plating technology, an electrolyte of Ni-Fe alloy is used. A plating system as shown in FIG. 2 may be used. As shown in FIG. 2, an end of coils 2 and 3 is connected with a conductive layer, with the other end connected with the N electrode of the plating power supply. The P electrode of the power supply 9 is connected to the P electrode of the cell 10 and the plating is started. The plating system is shown in FIG. 2.

During the plating process, an intermittent break control is used. In this embodiment, the plating is interrupted whenever a layer of plating of approximately 2 mm is accomplished. The plating process is restarted when an oxidized membrane is formed on the exposed plating. The process is repeated until needed thickness and layers of plating is obtained. See also FIG. 3, wherein soft magnetic layers 6, 7, 8 are shown, with each layer having an oxidized membrane 61, 71, 81 thereon.

In general, when the material is Permalloy, the electrolyte is an Ni-Fe solution and the plating rate is 4 ASD, the development speed of the plating layer is about 50 $\mu$m/hr. if the required thickness of the plated core structure is 40 $\mu$m, the plating may be accomplished within 1 hour, with number of sheets about 20.

In the present invention, because the plating circuit is connected in series, a magnetic field circuit will be formed on the conductive layer. This magnetic field defines the position and shape of the core structure and helps the plated layer to perform isotropic grain. As a result, a core structure with required shape and characters may be obtained.

Figure 3:
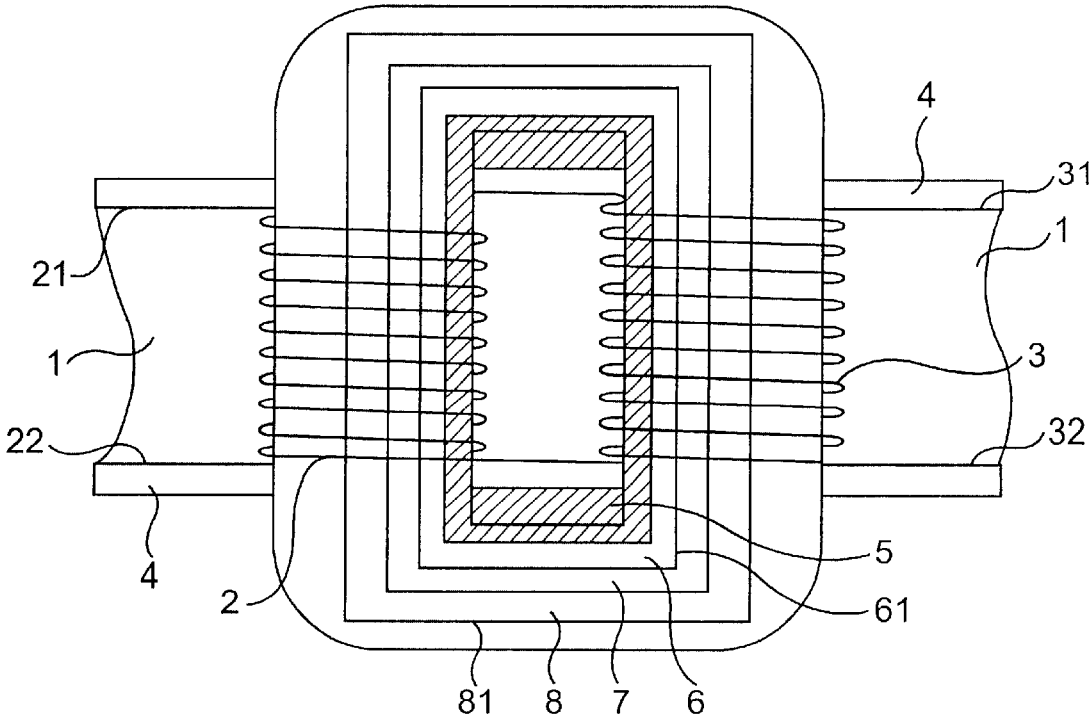
FIG. 3 illustrates the cross-sectional view of a transformer prepared according to the preparation method for inductance element of this invention.

FIG. 3 shows the cross sectional view of the inductance element so prepared.

Measurement of the core structure so prepared shows that its permeability is above 2,300 which is greater than the required permeability of about 100.

EFFECTS OF THE INVENTION

As shown in the above description, the structure and shape of the core structure of this invention may vary and adjusted according to the application of the inductance element. It is no longer necessary to prepare different molds for different inductance elements. The inductance element of this invention has a relative smaller size and cost and time consumed in the preparation may also be reduced.

The intermittent break control in the plating process helps to generate a multiple-layered structure for the cores, whereby the effective area of magnetic circuit may be increased.

During the plating of the core structure, the magnetic field generated by the coils helps the core material to perform anisotropic grain, whereby the soft magnetic characters of the core structure may be enhanced.

The transformer prepared according to this invention provides a high permeability, such that its transformation rate may be effectively enhanced. As the shape of the coil is ring shape, a better magnetic circuit is provided. As the core has a multiple-layered structure, its effective area of magnetic circuit may also be enlarged.

The present invention is applicable to inductance elements with single core, double core, multiple core or multilayer core.

As describe in the detailed description, the preparation method for inductance element of this invention provides a simplified process. As a result, the cost of the inductance element may be effectively reduced. The purpose of mass production of small-scaled conductance element may thus be achieved. Other advantages of this invention include low manufacture temperature and low pollution.

The invented method is applicable to all kinds of inductance element such as AC-AC transformers. Such transformer may be assembled with a Wheastone bridge to form an AC-DC transformer. In addition, the inductance element may be assembled with a passive element to form an actuator for motors, pumps, speakers etc.

The invented method may further be applied to elements such as sensors for current, electric field or magnetic field.

As the present invention has been shown and described with reference to preferred embodiments thereof, those skilled in the art will recognize that the above and other changes may be made therein without departing from the spirit and scope of the invention.

What is claimed is:

1. A method for manufacturing inductance elements comprising the steps of:

providing a substrate;

forming at least one coil having an external side on said substrate;

providing a conductive material and connecting the external side of said at least one coil with the conductive material to thereby function as a plating electrode; and, forming a multilevel multiple-layered magnetic structure of a soft magnetic material on said at least one coil by a plating process;

and wherein the plating process includes the step of forming a layer of the soft magnetic material on said at least one coil, stopping the plating process until an oxidized membrane is formed on the exposed plating, restarting the plating process after the formation of the oxidized membrane and depositing a second plating layer on said first layer and repeating the formation of an oxidized layer and plating steps until the desired thickness and layers of plating are obtained.

2. The method for manufacturing inductance elements according to claim 1 in which said plating process is interrupted whenever a layer of plating of approximately 2 mm is accomplished.

3. The method according to claim 1 wherein said at least one coil is a wound enameled wire coil, a planar coil or a coil formed on a printed circuit board.

4. The method according to claim 1 wherein said conductive material is metalized such that said multiple-layered magnetic structure may be developed on said at least one coil.

5. The method according to claim 2 wherein said soft magnetic material comprises a 21% Permalloy alloy or a super Permalloy.

* * * * *